US005601026A

United States Patent [19]

Röthemeyer et al.

[11] Patent Number: 5,601,026

[45] Date of Patent: Feb. 11, 1997

[54] PRESSURE-MEDIUM ACTIVATED LINEAR DRIVE SYSTEM

[75] Inventors: Fritz Röthemeyer, Isernhagen; Harald Kranz, Elze; Stefan Wode, Hanover; Wolfgang Kleiner, Hagenburg; Rainer Alles, Isernhagen; Roland Merten, Peine; Dieter Landweer, Hanover, all of Germany

[73] Assignee: Continental Aktiengesellschaft, Hanover, Germany

[21] Appl. No.: 440,420

[22] Filed: May 12, 1995

[30] Foreign Application Priority Data

May 13, 1994 [DE] Germany ..... 44 16 934.5

[51] Int. Cl.[6] ..... E01B 25/00

[52] U.S. Cl. ..... 104/155; 104/106; 104/107; 105/153

[58] Field of Search ..... 104/89, 93, 106, 104/107, 110, 118, 119, 155; 105/141, 144, 148, 150, 153

[56] References Cited

U.S. PATENT DOCUMENTS

| | | | |
|---|---|---|---|
| 3,318,262 | 5/1967 | Ganzinotti | 104/155 |
| 3,687,083 | 8/1972 | Brown | 104/155 |
| 3,691,961 | 9/1972 | Zeldman et al. | 104/155 |
| 3,805,705 | 4/1974 | Zeldmna et al. | 104/155 |
| 3,924,905 | 12/1975 | Simmons | 305/12 |
| 4,471,867 | 9/1984 | Forshee | 104/95 |
| 4,687,030 | 8/1987 | Faasse | 139/91 |
| 5,300,048 | 4/1994 | Drewes, Jr. et al. | 604/280 |

FOREIGN PATENT DOCUMENTS

| | | | |
|---|---|---|---|
| 1450723 | 7/1969 | Germany . | |
| 2718528 | 11/1978 | Germany . | |
| 2816546 | 10/1979 | Germany . | |
| 865724 | 9/1981 | U.S.S.R. | 104/155 |

OTHER PUBLICATIONS

"Engineering Materials and Their Applications: 3rd Edition", Flinn et al, Houghton–Mifflin Company. 1986.

*Primary Examiner*—S. Joseph Morano
*Attorney, Agent, or Firm*—Robert W. Becker & Associates

[57] ABSTRACT

A linear drive system has a guide rail and a transport device that is moveable along the guide rail. At least one tubular, flexible hollow body is positioned along the extension of the guide rail. The hollow body consists essentially of an elastomeric material and has a first and a second end. The at least one hollow body is loadable with a pressure medium from the first or the second end. At least one squeezing roller is rotatably connected to the transport device for forcing sealingly the at least one hollow body against a counter element. The guide rail consists essentially of a flexible elastomer.

9 Claims, 3 Drawing Sheets

PRESSURE-MEDIUM ACTIVATED LINEAR DRIVE SYSTEM

BACKGROUND OF THE INVENTION

The present Invention relates to a pressure medium-activated linear drive system comprising at least one tubular hollow body arranged along a guide rail which is actuatable from either end of the hollow body with a liquid or gaseous pressure medium and which is made of a flexible cross-linked or thermoplastic elastomer. The system further comprises at least one squeezing roller connected rotatably to a transport device that can be moved along the guide rail which squeezing roller presses the tubular hollow body against the guide rail or a counter roller.

Such linear drive systems are, for example, known from German documents 14 50 723, 27 18 528, and 28 16 546 in various embodiments. These known linear drive systems have the disadvantage that they are only suitable for a stationary rigid installation of their guide rail and an adaptation of the guide rail course entails considerable expenditures with respect to installation time and new parts.

It is therefore an object of the present invention to provide an inexpensively producible pressure-medium-actuated linear drive system that easily allows for a variable installation and can be positioned in any selected horizontal and/or vertical curve.

SUMMARY OF THE INVENTION

The linear drive system according to the present invention is primarily characterized by:

a guide rail;

a transport device movable along the guide rail;

at least one tubular, flexible hollow body connected to and positioned along the extension of the guide rail, the hollow body consisting essentially of an elastomeric material and having a first and a second end;

the at least one hollow body loadable with a pressure medium from the first and second ends;

at least one squeezing roller rotatably connected to the transport device for forcing sealingly the at least one hollow body against a counter element; and the guide rail consisting essentially of a flexible elastomer.

Preferably, the elastomeric material is selected from the group consisting of a cross-linked elastomeric material and a thermoplastic elastomeric material.

Advantageously, the elastomer is selected from the group consisting of a cross-linked elastomer and a thermoplastic elastomer.

Expediently, the guide rail and the at least one hollow body are a unitary member.

Advantageously, the unitary member is a flexible profiled member produced by coextrution.

Preferably, the at least one hollow body comprises an inner layer and an outer layer, wherein the inner layer is softer than the outer layer.

Between the inner layer and the outer layer a flexible reinforcement member braided of reinforcement elements is provided.

The braiding angle of the reinforcement elements is selected so as to neutralize axial forces acting on the hollow body.

Preferably, the at least one squeezing roller has a diameter selected to be two to four times the a diameter of the hollow body.

In a preferred embodiment of the present invention, the counter element is the guide rail. In the alternative, the counter element is a counter roller.

Due to the use of primarily polymer materials for the entire active system of the inventive linear drive system the typical properties of such materials, i.e., flexibility, elasticity, long service life under changing loads, wear resistance, excellent weatherability, chemical resistance as well as well known technologies for their production and molding, already proven in practice, can be used fully. Furthermore, requirements with respect to recycling of the materials can be taken into consideration.

In an especially advantageous embodiment the flexible guide rails and the flexible tubular hollow body of the inventive linear drive system can be embodied as a unitary member, i.e., the two components are connected frictionally and/or from-lockingly to a practical, suitable unit. This can be realized particularly expediently by providing that the guide rail and the tubular hollow body are in the form of a flexible profiled member produced by coextrution such that the tubular hollow body is integrated on one side of the profiled member as a channel extending in the longitudinally direction of the member. The cross-sectional portion of the profiled member which represents the guide rail is formed of a relatively hard polymer while the portion of the cross-section which formes the tubular hollow body comprises an outer layer or outer wall which is made of an especially elastic-flexible material.

The tubular hollow body however may also be in the form of a conventional separate hose and be connected form-fittingly to the guide rail, especially by providing a tongue unitary with the hollow body to be inserted into a groove of the guide rail. Furthermore, it may be expedient that the walls of the tubular hollow body are such that they comprise a soft inner layer end a relatively harder outer layer so that the rolling of the squeezing roller is improved and wear is reduced. Between the inner layer and the outer layer a flexible braided reinforcement member may be preferably provided. Its braiding angle is adjusted to the requirements with respect to neutralizing the axial forces.

It has been shown that with the inventive linear drive system very high advancing forces can be generated when the diameter of the squeezing roller, and optionally of the counter roller paired therewith, corresponds to two to four times the diameter of the tubular hollow body.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 6.

Figure 1:
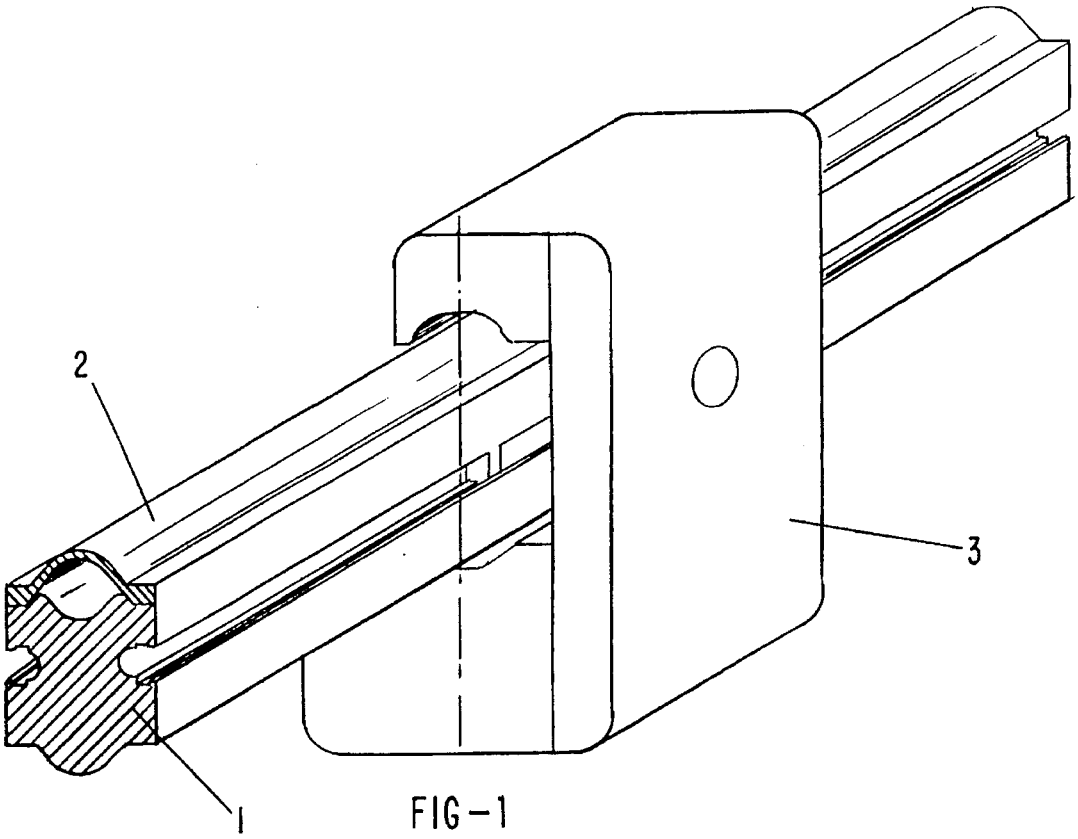
FIG. 1 shows the inventively near drive system in a perspective representation.

The embodiment represented in FIG. 1 has a guide rail 1 and a tubular hollow body 2 forming together a unitary member in the form of a profiled member that consists essentially completely of a flexible cross-linked or thermoplastic elastomer. Along the guide rail and the hollow body the transport device 3 is moved. The polymer materials for the parts 1 and 2 are selected according to the required specifications such that part 1 is comprised of a relatively hard, bendable material, while part 2 is comprised of a very flexible, elastic material. Both parts can be manufactured separately and can be subsequently joined by fusing or gluing. It is also possible to provide the profiled member as a unitary member produced by coextrution.

Figure 2:
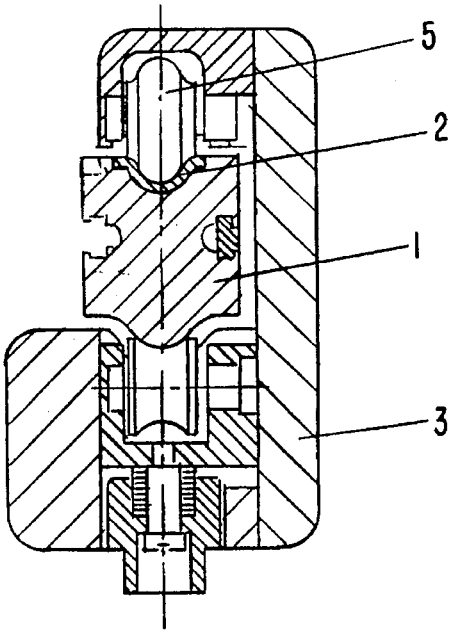
FIG. 2 shows the same drive system in cross-section.

As shown in FIG. 2, the upper part of the transport device 3 has arranged thereat a squeezing roller 5 which forces the tubular hollow body 2 against the guide rail 1 to thereby seal the hollow channel.

Figure 3:
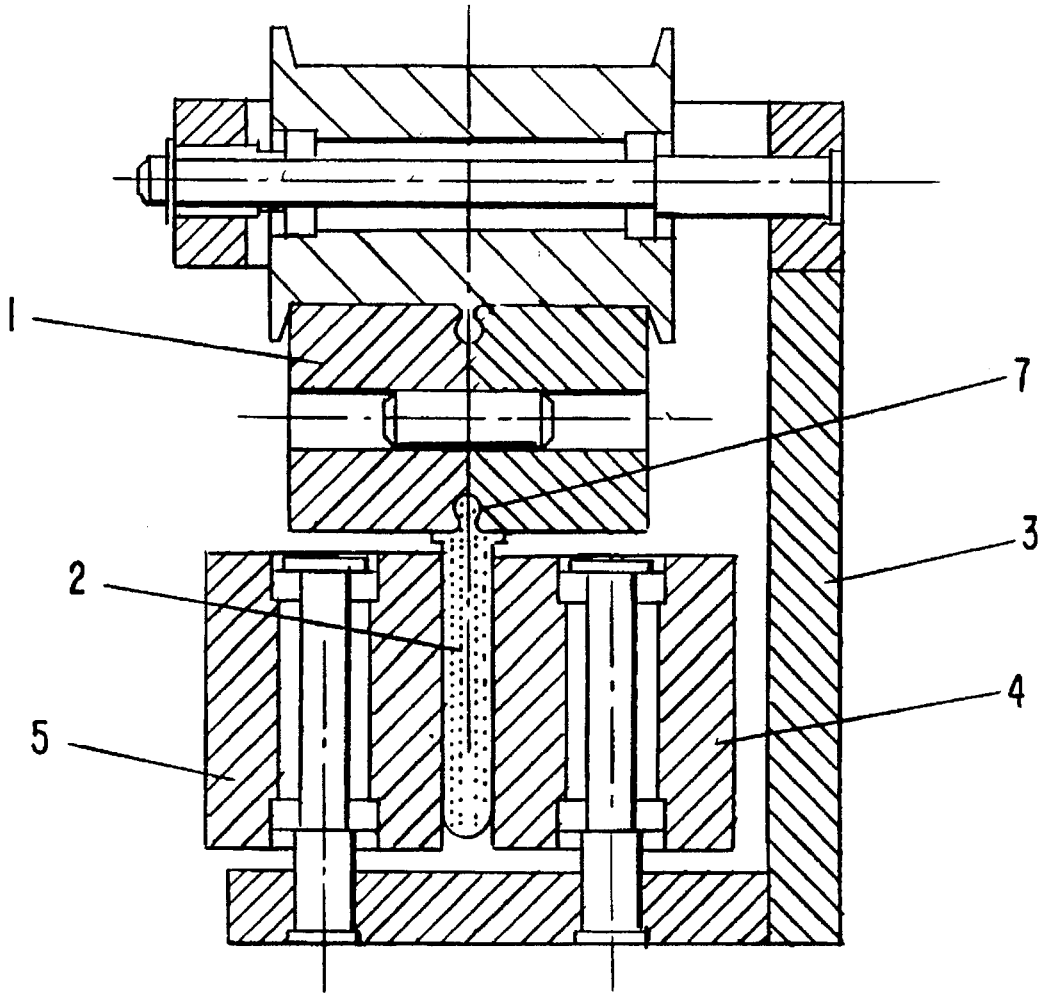
FIG. 3 shows another embodiment of the inventive drive system in cross section.

In the embodiment according to FIG. 3 the tubular hollow body 2 is a separate component and is connected in a form-locking manner with a tongue 7 formed as a unitary part of the hollow body 2 to the guide rail 1. The tubular hollow body 2 is compressed by a squeezing roller 5 and a counter roller 4 paired therewith.

Figure 4:
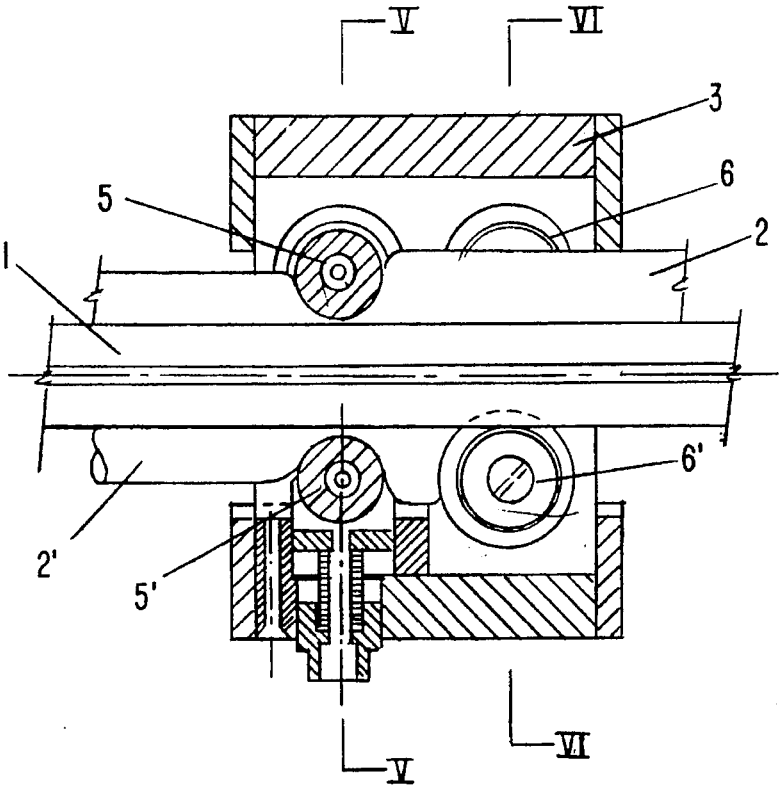
FIG. 4 shows a third embodiment in longitudinal section.
Figure 5:
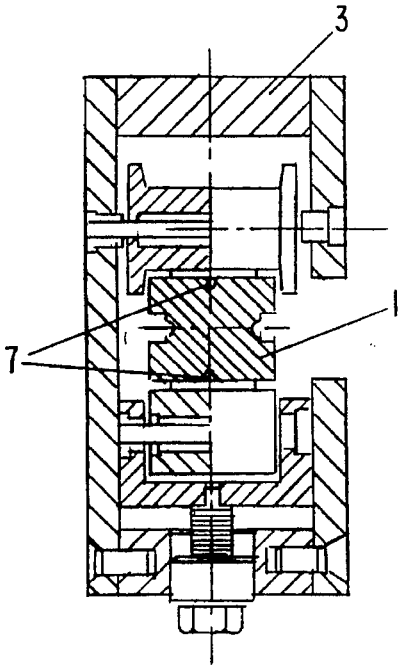
FIG. 5 shows the cross-section V—V of FIG. 4.
Figure 6:
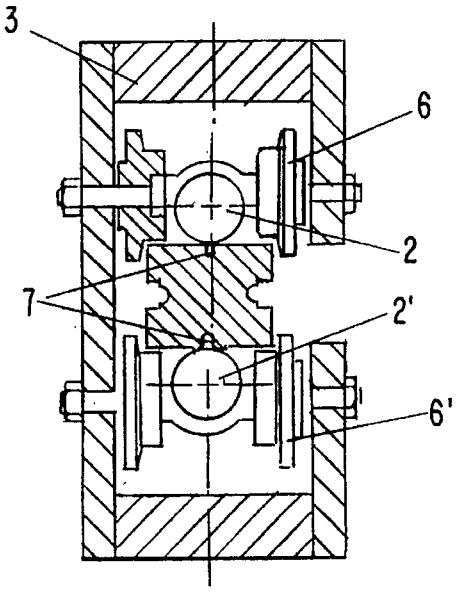
FIG. 6 shows the cross-section VI—VI of FIG. 4.

FIGS. 4, 5, 6 show an especially advantageous embodiment of the invention which is characterized by being able to realize especially high advancing forces. For this purpose the guide rail 1 is provided with a first and a second tubular hollow body 2, 2' above and below the guide rail 1 having coordinated therewith a squeezing roller 5, respectively, 5' supported at the transport device 3. Furthermore, a guide roller pair 6 and 6' is provided that rolls along the guide rail 1. The tubular hollow bodies 2 and 2' which are squeezed and tightly sealed by the squeezing rollers 5 and 5' perpendicular to the guide rail 1 are connected in a form-locking arrangement with the guide rail 1 by providing thereat a tongue arrangement. The present invention is, of course, in no way restricted to the specific disclosure of the specification, examples, and drawings, but also encompasses any modifications within the scope of the appended claims.

What we claim is:

1. A linear drive system comprising:

a guide rail;

a transport device movable along said guide rail;

at least one tubular, flexible hollow body connected to and positioned along an extension of said guide rail, said hollow body consisting essentially of an elastomeric material and having a first and a second end;

said at least one hollow body loadable with a pressure medium from one of said first and second ends;

at least one squeezing roller rotatably connected to said transport device for forcing sealingly said at least one hollow body against a counter element; and said guide rail consisting essentially of a flexible elastomer.

2. A linear drive system according to claim 1, wherein said elastomeric material is selected from the group consisting of a cross-linked elastomeric material and a thermoplastic elastomeric material.

3. A linear drive system according to claim 1, wherein said elastomer is selected from the group consisting of a cross-linked elastomer and a thermoplastic elastomer.

4. A linear drive system according to claim 1, wherein said guide rail and said at least one hollow body are a unitary member.

5. A linear drive system according to claim 4, wherein said unitary member is a flexible profiled member produced by coextrusion.

6. A linear drive system according to claim 1, wherein said at least one hollow body comprises an inner layer and an outer layer, wherein said inner layer is softer than said outer layer.

7. A linear drive system according to claim 1, wherein said at least one squeezing roller has a diameter selected to be 2–4 times a diameter of said hollow body.

8. A linear drive system according to claim 1, wherein said counter element is said guide rail.

9. A linear drive system according to claim 1, wherein said counter element is a counter roller.

* * * * *